US008759705B2

(12) United States Patent
Funakoshi et al.

(10) Patent No.: US 8,759,705 B2
(45) Date of Patent: Jun. 24, 2014

(54) PUSH BUTTON-TYPE SWITCH DEVICE

(75) Inventors: Katsuya Funakoshi, Shinagawa (JP); Shuji Nakamura, Shinagawa (JP); Takeshi Nishino, Shinagawa (JP); Junichi Maruyama, Shinagawa (JP); Tamotsu Koike, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 208 days.

(21) Appl. No.: 13/362,711

(22) Filed: Jan. 31, 2012

(65) Prior Publication Data

US 2012/0228107 A1 Sep. 13, 2012

(30) Foreign Application Priority Data

Mar. 7, 2011 (JP) ..... 2011-049152

(51) Int. Cl.
*H01H 13/36* (2006.01)
*H01H 3/12* (2006.01)
*H01H 13/14* (2006.01)

(52) U.S. Cl.
CPC ..... *H01H 3/125* (2013.01); *H01H 2203/038* (2013.01); *H01H 13/36* (2013.01); *H01H 13/14* (2013.01)
USPC ..... 200/532; 200/344

(58) Field of Classification Search
CPC ..... H01H 3/125; H01H 2203/038; H01H 2215/012; H01H 2237/00; H01H 13/36; H01H 13/02; H01H 13/14
USPC ..... 200/532, 344
See application file for complete search history.

(56) References Cited

U.S. PATENT DOCUMENTS

| | | | | |
|---|---|---|---|---|
| 5,657,860 | A * | 8/1997 | Koike et al. | 200/344 |
| 6,060,676 | A * | 5/2000 | Pan | 200/344 |
| 6,812,421 | B2 * | 11/2004 | Sato et al. | 200/344 |
| 6,906,272 | B1 * | 6/2005 | Tsai | 200/344 |
| 7,312,414 | B2 * | 12/2007 | Yatsu et al. | 200/344 |
| 8,299,382 | B2 * | 10/2012 | Takemae et al. | 200/344 |
| 2001/0007301 | A1 * | 7/2001 | Sato et al. | 200/344 |
| 2009/0078552 | A1 * | 3/2009 | Takemae et al. | 200/344 |

FOREIGN PATENT DOCUMENTS

| | | |
|---|---|---|
| EP | 2040275 | 3/2009 |
| JP | 9-120741 | 5/1997 |

OTHER PUBLICATIONS

Extended European Search Report dated Jun. 27, 2012 issued in corresponding European Patent Application No. 12158102.9.

* cited by examiner

*Primary Examiner* — Kyung Lee
(74) *Attorney, Agent, or Firm* — Staas & Halsey LLP

(57) ABSTRACT

A push button-type switch device includes a pair of fixed contacts, an operable member to be pushed, an actuating member elastically deformable upon the operable member being pushed, a movable contact which short-circuits the pair of fixed contacts due to elastic deformation of the actuating member, and a limiting part arranged to limit a direction in which the operable member moves and making the operable member move in a fixed orientation. The limiting part includes a pair of link members that engage with each other, one ends of the link members rotatably supported by the base portion, and the other ends thereof slidably supported by the operable member. This produces a good click irrespective of a position where the operable member is operated.

17 Claims, 16 Drawing Sheets

LEFT ⟷ RIGHT

PUSH BUTTON-TYPE SWITCH DEVICE

CROSS-REFERENCE TO RELATED APPLICATIONS

This application is based upon and claims the benefit of priority from prior Japanese Patent Application No. 2011-049152 filed on Mar. 7, 2011, the entire contents of which are incorporated herein by reference.

BACKGROUND OF THE INVENTION

1. Field of the Invention

This invention relates to a push button-type switch device used for a variety of electronic equipment.

2. Description of the Related Art

There has heretofore been known a push button-type switch device having a key top supported via a skirt portion which is made of an elastic material (see, for example, JP-A-9-120741). According to the switch device described in JP-A-9-120741, a pair of fixed contacts are arranged on a surface of a circuit board, while a movable contact is arranged on an inner lower surface of the key top, and the key top is operated to elastically deform the skirt portion, so as to provide a unique operability with click feeling when the movable contact comes into contact with the fixed contacts.

In the device described in JP-A-9-120741, however, if the key top has, for example, an oval shape, upon pushing an end of the key top, the key top becomes tilted and the pushing force acts in an oblique direction which tilts relative to the skirt portion. This results in non-uniformity in the deformation of the skirt portion in the circumferential direction, and a favorable click may not be obtained.

SUMMARY OF THE INVENTION

A push button-type switch device according to the present invention comprises a base portion provided with a pair of fixed contacts, an operable member which moves toward the base portion upon being pushed, an actuating member interposed between the base portion and the operable member and elastically deformable upon the operable member being pushed, the actuating member providing a nonlinear counteracting force to the operable member, depending upon elastic deformation of the actuating member, a movable contact which comes into contact with the pair of fixed contacts due to the elastic deformation upon the operable member being pushed, the movable contact short-circuiting the pair of fixed contacts, and a limiting part which cooperates with the operable member upon the operable member being pushed, the limiting part limiting a direction in which the operable member moves and making the operable member move in a fixed orientation, wherein the limiting part includes a pair of link members that engage with each other, one ends of the pair of link members being rotatably supported by the base portion, respectively, and other ends of the pair of link members being slidably supported by the operable member, respectively.

According to the present invention, the direction in which the operable member moves upon being pushed is limited so as to allow the operable member to move in a fixed orientation. Therefore, the actuating member between the base portion and the operable member can be elastically deformed uniformly in the circumferential direction to produce a good click when being pushed.

These and other objects, features and advantages of the present invention will be more apparent in light of the detailed description of exemplary embodiments thereof as illustrated by the drawings.

DETAILED DESCRIPTION

Figure 1:
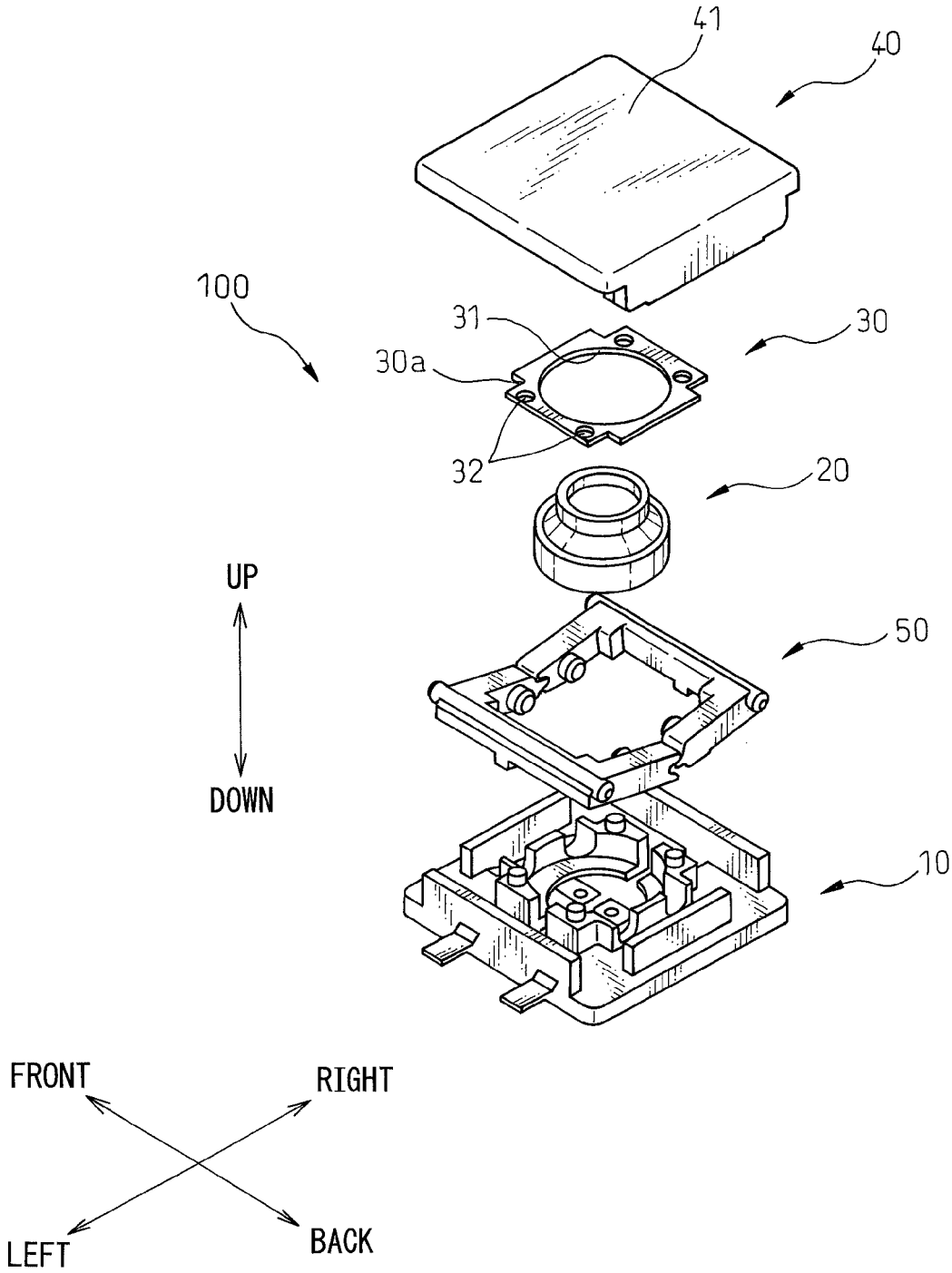
FIG. 1 is an exploded perspective view of a push button-type switch device according to one embodiment of the present invention.
Figure 2:
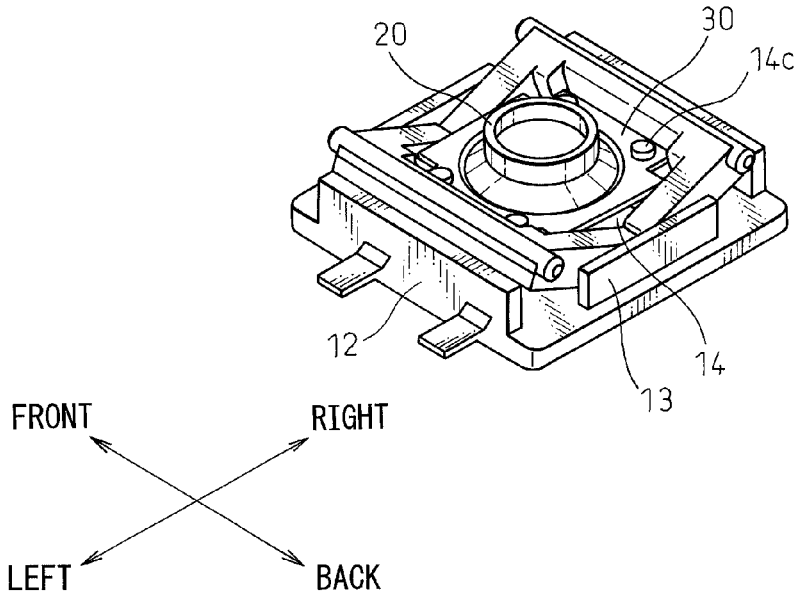
FIG. 2 is a perspective view of the push button-type switch device of FIG. 1 in an assembled state.

A push button-type switch device according to one embodiment of the invention will now be described. FIG. 1 is an exploded perspective view illustrating an overall constitution of the push button-type switch device 100 according to the embodiment of the present invention. FIG. 2 is a perspective view of the push button-type switch device 100 in an assembled state. In FIG. 2, a key top 40 is not shown. In the following description for convenience, the up-and-down direction, front-and-back direction and right-and-left direction are defined as shown in the figures, and a constitution of each portion will be described according to these definitions.

The push button-type switch device 100 includes a base portion 10, an actuating member 20 placed on an upper surface of the base portion 10, a cover 30 attached to the base portion 10 with the actuating member 20 provided therebetween, a key top 40 that is to be pushed downward in operation, and a pair of right and left link members 50 arranged between the base portion 10 and the key top 40.

Figure 3:
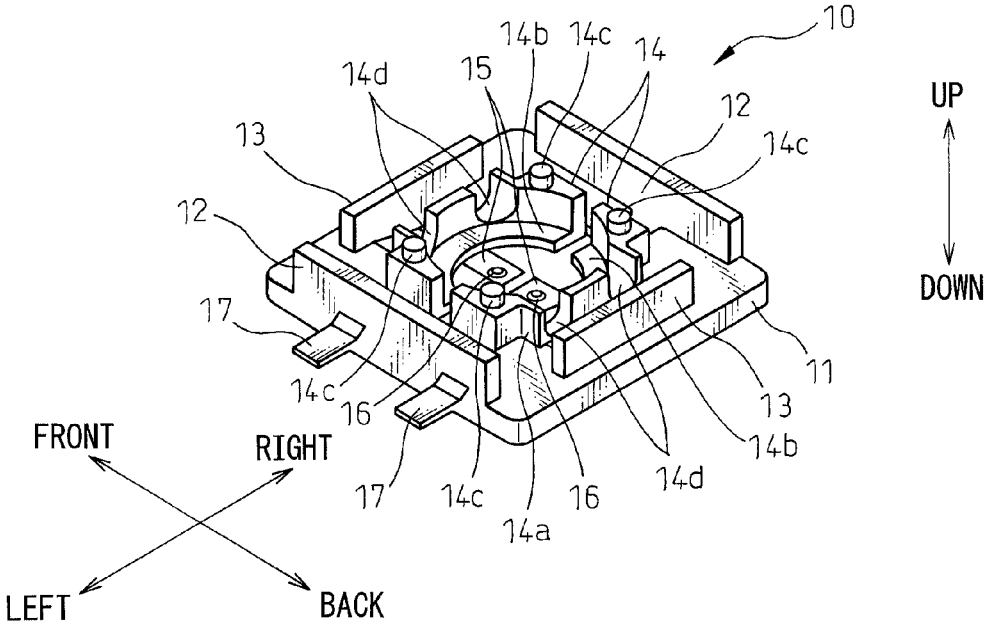
FIG. 3 is an enlarged view of a base portion of FIG. 1.

FIG. 3 is an enlarged perspective view of the base portion 10. The base portion 10 includes a bottom plate 11 of a substantially rectangular shape, a pair of right and left side plates 12 protruding upward from the right and left edges of the upper surface of the bottom plate 11 and extending in the form of a flat plate in the front-and-back direction, a pair of front and back side plates 13 protruding upward from the front and back ends of the upper surface of the bottom plate 11 and extending in the form of a flat plate in the right-and-left direction, and a pair of front and back guide portions 14 protruding upward on the upper surface of the bottom plate 11 and inside the side plates 12 and 13. The base portion 10 is made of an electrically non-conductive resin and integrally formed.

The guide portions 14 are in the form of a substantially U-shape in a plan view and arranged opposite to each other in the front-and-back direction, and their outer side surfaces facing the side plates 12, 13 are formed in the form of a flat plate substantially in parallel with the side plates 12, 13. The guide portions 14 have inwardly cut-away portions of a rectangular shape at their right and left corners, so as to form recesses 14*a* at four corners of the pair of guide members 14 as a whole. The inner side surfaces of the guide members 14, on the other hand, are formed of an arcuate shape, so as to form a cylindrical accommodation space on the insides of the pair of guide members 14. The bottom surfaces of the guide portions 14 extend inward, so as to form seat portions 14*b*. The inner circumferential edges of the seat portions 14*b* are in the form of an arcuate shape, so as to form a recess of a substantially circular shape on the insides of a pair of the seat portions 14*b*.

On the upper surfaces at the right and left ends of the guide portions 14, cylindrical protrusions 14*c* are arranged so as to protrude upward. At each of the front and back ends of the guide portions 14, a pair of right and left arcuate shaft-receiving grooves 14*d* are formed from the upper end surfaces toward the lower sides of the guide portions 14.

A pair of electrically conductive plates 15 are placed on the upper surface of the bottom plate 11. The plates 15 extend into the recessed portion inside the guide portions 14 in the front-and-back direction, so that one ends of the plates 15 are positioned close to each other, and electrically conductive fixed contacts 16 are formed so as to be raised upward on the upper surfaces at the ends of the plates 15. The plates 15 extend leftward under the front and back guide portions 14, and the other ends, which extend through the left side plate 12, are connected to connection terminals 17, respectively. The plates 15 are formed integrally with the base portion 10 by, for example, insert-molding.

Figure 4:
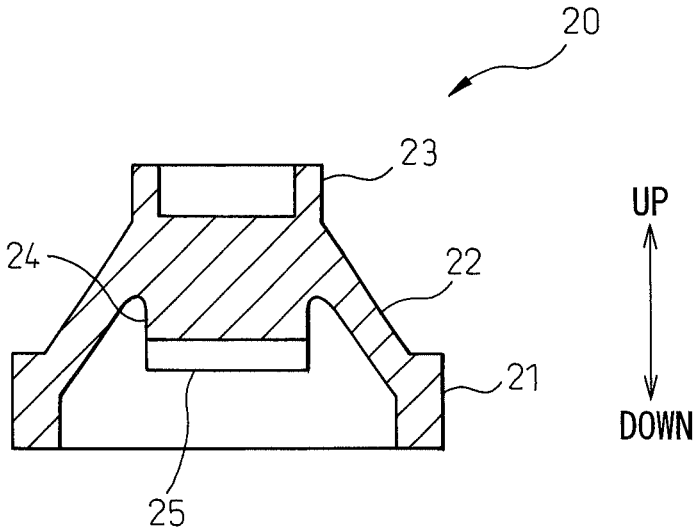
FIG. 4 is a sectional view of an actuating member of FIG. 1.

FIG. 4 is a sectional view of the actuating member 20. The actuating member 20 has a symmetrical shape with the center axis in the up-and-down direction as a center, and is in the form of a substantially dome as a whole. Namely, the actuating member 20 includes a circular ring portion 21, a tapered portion 22 extending upward in a tapered manner from an inner circumferential edge of the circular ring portion 21, and a circular ring portion 23 erecting on the upper edge of the tapered portion 22. A protrusion 24 of a substantially cylindrical shape is raised from the lower part of the circular ring portion 23, and an electrically conductive movable contact 25 is provided on the lower surface of the protrusion 24. The actuating member 20 may be an elastic element made of a rubber material. The movable contact 25 may be made of an electrically conductive rubber and integrally formed with the actuating member 20 by integral forming. The movable contact 25 may also be formed on the lower surface of the protrusion 24 by electrically conductive printing. The movable contact 25 together with the fixed contacts 16 serves as a switch contact portion.

The actuating member 20 is accommodated in the accommodation space inside the guide portions 14 of the base portion 10, and the circular ring portion 21 is placed on the seat portions 14*b*. In a state where the actuating member 20 has been placed on the base portion 10, the movable contact 25 is positioned the pair of fixed contacts 16. Prior to exertion of pushing force on the actuating member 20, the movable contact 25 is at an upper limit position spaced apart from the fixed contacts 16, and the switch contact portion is open. Upon pushing force being exerted downward on the actuating member 20, the tapered portion 22 is subject to elastic deformation, so that the movable contact 25 lowers and comes into contact with the pair of fixed contacts 16. This allows the pair of fixed contacts 16 to short-circuit via the movable contact 25, thereby closing the switch contact portion.

A cover 30 in the form of a thin plate as shown in FIG. 1 is arranged on the actuating member 20. The cover 30 is made of, for example, a resin and integrally formed by integral forming. The cover 30 has an outer shape of a substantially rectangular and has, at its corners, notches 30*a* which correspond to the recesses 14*a* of the guide portions 14 (FIG. 3). The outer shape of the cover 30 conforms with the outer shape of the pair of guide portions 14. At the central part of the cover 30, a circular through hole 31 is formed in such a size smaller than an outer diameter of the circular ring portion 21 of the actuating member 20 (FIG. 4) that it does not interfere with the tapered portion 22, which is elastically deformable.

The cover 30 further has circular through holes 32 corresponding to the protrusions 14*c* of the base portion 10 (FIG. 3). In the assembled state as shown in FIG. 2, the protrusions 14*c* are inserted in the through holes 32. In this state, the upper ends of the protrusions 14*c* are crushed by means of a hammer or the like, the cover 30 is fixed onto the upper surfaces of the guide portions 14, and the circular ring portion 21 of the actuating member 20 is held between the seat portions 14*b* and the cover 30. The cover 30 may also be fixed onto the upper surfaces of the guide portions 14 by melting the upper ends of the protrusions 14*c* by heat.

Figure 5:
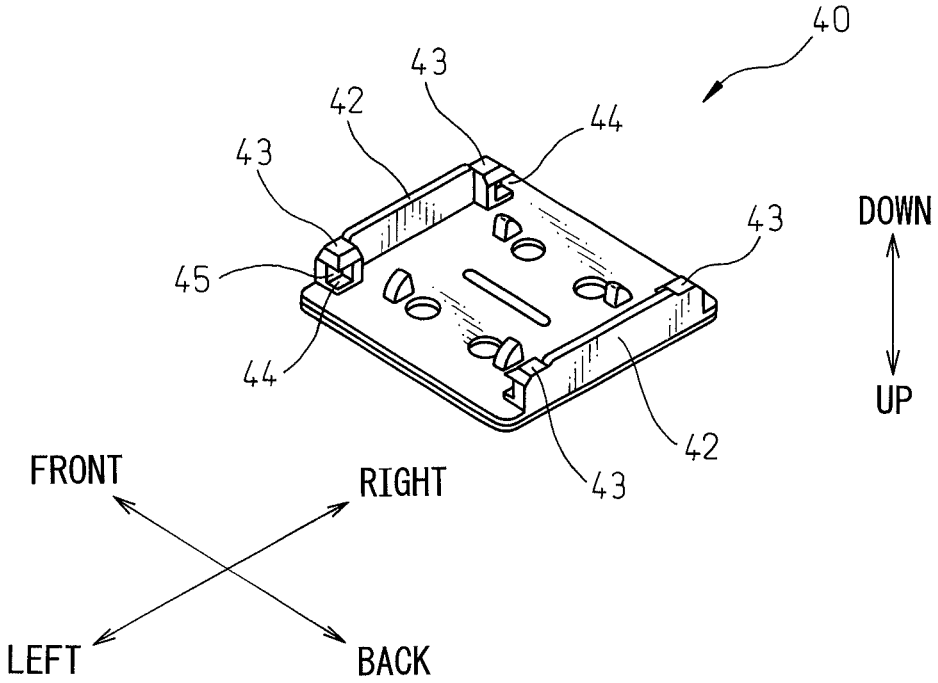
FIG. 5 is a perspective view of a key top of FIG. 1 obliquely seen from its lower side.

FIG. 5 is a perspective view of the key top 40 obliquely seen from its lower side. The key top 40 as a whole is in the form of a flat plate of a substantially rectangular shape, made of resin and formed by integral forming. An operable portion 41 (FIG. 1) which is to be pushed is provided on the upper surface (outer surface) of the key top 40, and a pair of front and back side plates 42 in the form of a flat plate extending in the right-and-left direction is provided, so as to protrude downward at the front and back end on the lower surface (inner surface) of the key top 40.

The key top 40 has a length in the front-and-back direction substantially equal to a length in the front-and-back direction of the base portion 10, and has a length in the right-and-left direction substantially equal to a length in the right-and-left direction of the base portion 10. In the state where the switch device 100 has been assembled, the pair of side plates 42 are positioned outside the pair of side plates 13 of the base portion 10 in the front-and-back direction. The right and left ends of the side plates 42 are thickened inwardly in the front-and-back direction, and guide grooves 44 are formed on the right and left outer side surfaces of the thickened part, so as to form shaft support portions 43 at the right and left ends of the side plates 42.

Figure 6:
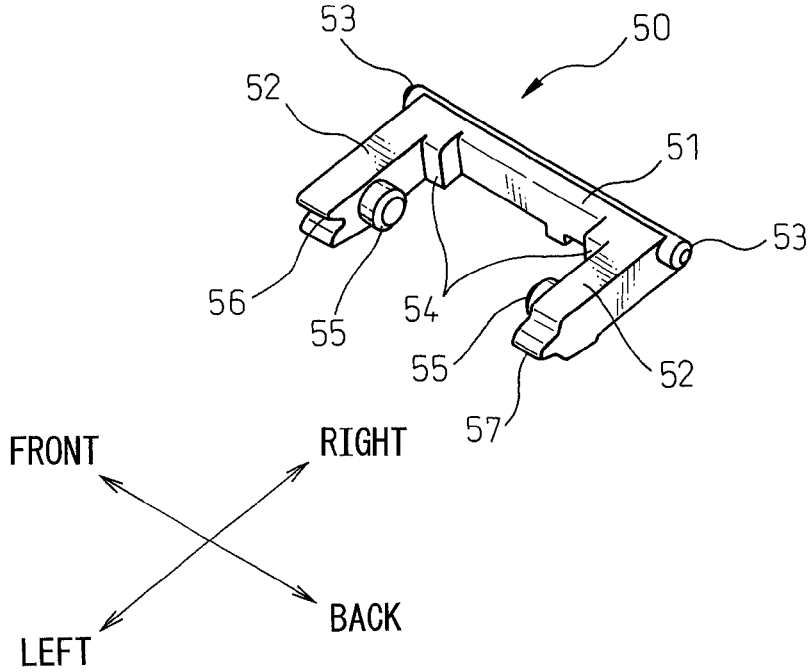
FIG. 6 is a perspective view illustrating the constitution of a link member of FIG. 1.

FIG. 6 is a perspective view illustrating the constitution of the link member 50. Shown here is the constitution of the link member 50 on the right side of FIG. 1. The right and left link members 50, however, have the same constitution and thus, if turned by 180 degrees on a horizontal plane, then the right link member 50 becomes the left link member 50.

The link member 50 is made of a resin and formed by integral forming, and has, as shown in FIG. 6, a body portion 51 extending in the front-and-back direction and a pair of front and back arm portions 52 extending leftward from the front and back ends of the body portion 51, forming a substantially U-shape as a whole. On a rear surface (right end surface) of the body portion 51, a substantially cylindrical guide shaft 53 integrally extends along the body portion 51, and both ends of the guide shaft 53 protrude outward in the front-and-back direction beyond the front and back end surfaces of the arm portions 52.

The arm portions 52 have a substantially rectangular shape in cross section, its inner side surfaces at proximal ends (right ends) having a stepped shape, i.e., forming a step 54 protruding inward in the front-and-back direction, respectively. On the inner side surfaces at distal ends of the arm portions 52, substantially cylindrical shaft portions 55 are provided so as to coaxially protrude in the front-and-back direction. A concave portion 56 is formed in the left end surface of the front arm portion 52 and a convex portion 57 is formed on the left end surface of the back arm portion 52.

The concave portion 56 of one link member 50 meshes with the convex portion 57 of the other link member 50, while the convex portion 57 of one link member 50 meshes with the concave portion 56 of the other link member 50. In this way, a V-shaped gear link of a V-shape in side view is provided, as shown in FIG. 1. The shaft portions 55 of the link members 50 are fitted to the shaft-receiving grooves 14*d* of the base portion 10 (FIG. 3) from the upper side. Here, the link members 50 are arranged in spaces between the guide portions 14 and the side plates 12, 13, respectively, as shown in FIG. 2. Namely, the link members 50 are rotatably supported by the base portion 10 with the shaft portions 55 as fulcrums without interfering with the guide portions 14 or the side plates 12, 13.

Figure 7:
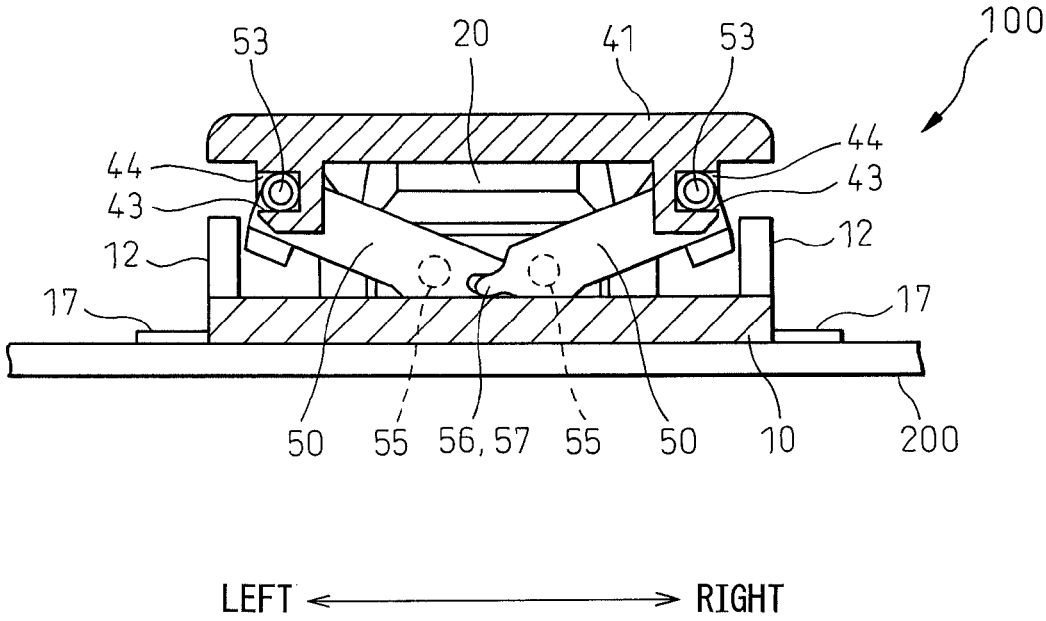
FIG. 7 is a sectional view of a major portion of the push button-type switch device according to the embodiment of the invention in an assembled state.

FIG. 7 is a sectional view of a major portion of the push button-type switch device 100, illustrating an initial state thereof before the key top 40 is pushed. The switch device 100 is mounted, for example, on a printed board 200. The printed board 200 has an electric circuit of an electrically conductive wiring pattern formed on an insulating plate. The base portion 10 is placed on the printed board 200, and connection terminals 17 are connected to the electric circuit on the printed board 200 by soldering or the like.

In the state where the switch device 100 has been assembled, the pair of link members 50 mesh with each other, and the shaft portions 55 of the link members 50 are rotatably supported by the shaft-receiving grooves 14*d* of the base portion 10. Further, the guide shafts 53 of the link members 50 are inserted in the guide grooves 44 on the inner side of the key top 40, the guide shafts 53 of the link members 50 being supported by the shaft support portions 43 of the key top 40 so as to slide along the guide grooves 44.

With such a constitution when a pushing force acts on the operable portion 41 of the key top 40, the actuating member 20 is subject to elastic deformation by being pushed and flattened out, whereby the link members 50 pivot together in the opposite directions. The guide shafts 53 then slide in the guide grooves 44 in the right-and-left direction, and the key top 40 undergoes a downward translation movement, while maintaining the operable portion 41 in a predetermined substantially horizontal orientation. As the key top 40 moves to its lower limit position in the key stroke, the movable contact 25 comes into contact with the fixed contacts 16 to close the switch contact portion.

When the pushing force acting upon the key top 40 is released, with the aide of sliding movement of the link members 50, the key top 40 is moved upward by elastic force of the actuating member 20, while maintaining the horizontal orientation, until it reaches its upper limit position in the key stroke. The upper limit position in the key stroke is defined as the guide shafts 53 of the link members 50 are stopped by the inner walls of the shaft support portions 43 of the key top 40 in the right-and-left direction.

The embodiment of the invention has the following operations and effects.

(1) The shaft portions 55 at the proximal end of the pair of link members 50 which mesh with each other are rotatably supported by the shaft-receiving portions 14*d* of the base portion 10, and the guide shafts 53 at the distal end of the pair of link members 50 are supported by the shaft support portions 43 on the inner side of the key top 40 so as to slide in the right-and-left direction. This allows the key top 40 to maintain its horizontal orientation without tilting even if an end of the operable portion 41 of the key top 40 is pushed. Therefore, the actuating member 20 is subject to elastic deformation uniformly in the circumferential direction, producing good click feeling, thereby improving operability of the switch device 100, and stabilizing the opening/closing operation of the switch contact portion.

(2) When the key top 40 is pushed down, the link members 50 are accommodated in the spaces formed between the side plats 12, 13 and the guide portions 14 of the base portion 10. This allows the link members 50 to pivot without interfering with the base portion 10 or the actuating member 20, whereby the height of the switch device 100 can be easily lowered.

(3) The link members 50 are formed of a substantially U-shape and are arranged to surround the actuating member 20, thereby enabling the switch device 100 to be compact in size in both the front-and-back direction and the right-and-left direction.

(4) The movable contact 25 is provided on the protrusion 24 inside the actuating member 20 by integral forming, whereby the movable contact 25 is stably attached to the actuating member 20.

(5) The push button-type switch device 100 is constituted by arranging, on the base portion 10, the actuating member 20, the cover 30 and the key top 40 on top of one another, whereby the switch device 100 can be easily assembled.

Figure 8A:
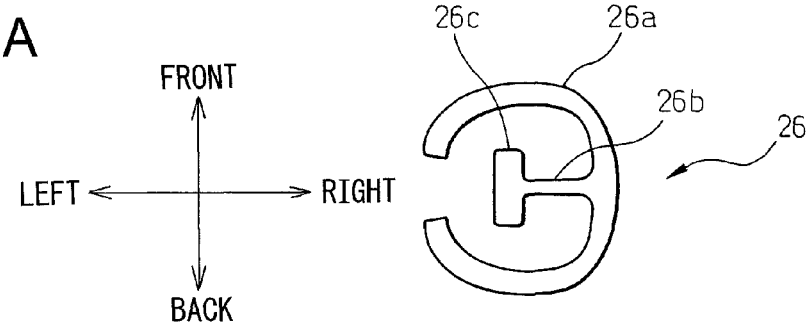
FIGS. 8A and 8B is a view illustrating a modified example of a movable contact.
Figure 8B:
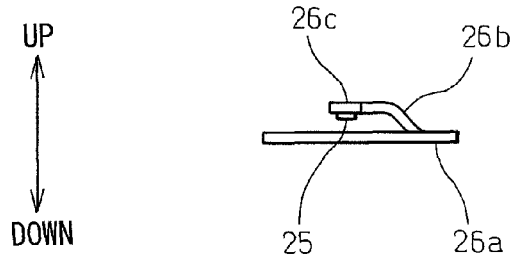

Although the movable contact 25 is provided on the inside of the actuating member 20 by integral forming, the constitution of the movable contact 25 is not limited thereto. As shown in FIGS. 8A and 8B, for example, the movable contact 25 may also be provided on a leaf spring 26 made of an electrically conductive metal. FIG. 8A is a plan view of the leaf spring 26, FIG. 8B is a side view of the same. The leaf spring 26 includes a flat plate portion 26*a* of a substantially C-shape, a leaf spring portion 26*b* extending upward from the inner circumferential edge of the flat plate portion 26*a* and toward the center of the leaf spring 26, and a contact portion 26*c* extending widely in the front-and-back direction at an end of the leaf spring portion 26*b*. The movable contact 25 is provided on the lower surface of the contact portion 26*c*.

In this case, the flat plate portion 26*a* is formed of substantially the same shape as the seat portions 14*b* of the base portion 10 (FIG. 3), and is held between the seat portions 14*b* and the circular ring portion 21 of the actuating member 20 with the flat plate portion 26*a* being insulated from the fixed contacts 16. In this manner, the movable contact 25 is positioned over the fixed contacts 16. When the contact portion 26*c* is pushed via the protrusion 24 (FIG. 4) inside the actuating member 20 as a result of the key top 40 being pushed, the leaf spring portion 26*c* is subject to elastic deformation, bringing the movable contact 25 into contact with the fixed contacts 16. On the other hand, when the pushing force acting upon the key top 40 is released and the protrusion 24 of the actuating member 20 moves up, the contact portion 26*c* moves up due to spring force of the leaf spring portion 26*b*, lifting the movable contact 25 away from the fixed contacts 16.

Figure 9A:
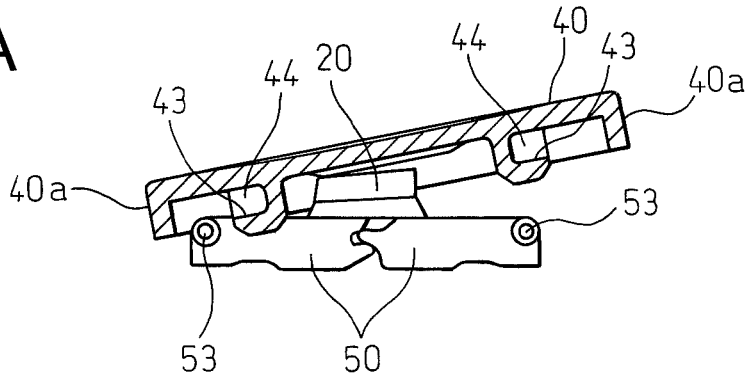
FIGS. 9A, 9B and 9C is a sectional view of a major portion of the push button-type switch device illustrating an example of the steps of attaching the key top.
Figure 9B:
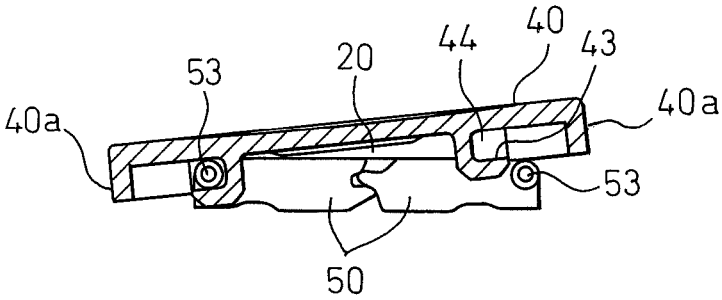
Figure 9C:
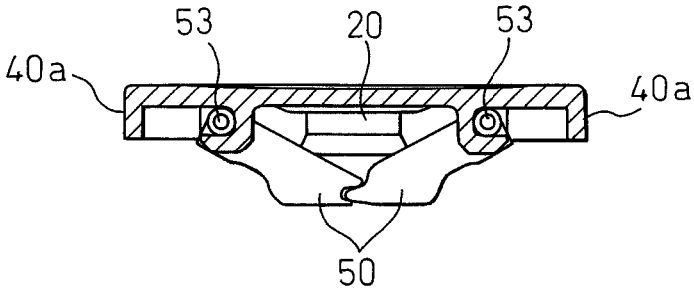

In the state where the push button-type switch device 100 has been assembled, the key top 40 is attached by inserting the guide shafts 53 of the link members 50 into the guide grooves 44 of the key top 40. The attaching step is performed, for example, as described below. FIGS. 9A, 9B and 9C is a sectional view of a major portion of the push button-type switch device 100 illustrating an example of the attaching step of the key top 40. In FIGS. 9A, 9B and 9C, side walls 40*a* protrude downward on the outer sides in the right-and-left direction of the guide grooves 44 of the key top 40.

First, in this case as shown in FIG. 9A, the pair of front and back guide shafts 53 of the left side are inserted into the guide grooves 44 of the left side, while the key top 40 being tilted. Next, as shown in FIG. 9B, while the guide shafts 53 of the left side are inserted in the innermost positions of the guide grooves 44, the key top 40 is pushed down against the actuating member 20 and turned downward the right side of the key top 40 until it reaches the lower limit position. The key top 40 is then shifted rightward, and the pair of front and back guide shafts 53 are inserted into the guide grooves 44 of the right side. Thereafter, pushing the key top 40 is terminated, and then, as shown in FIG. 9C, the key top 40 is urged up by elastic force of the actuating member 20, whereby the attaching step is completed.

Figure 10A:
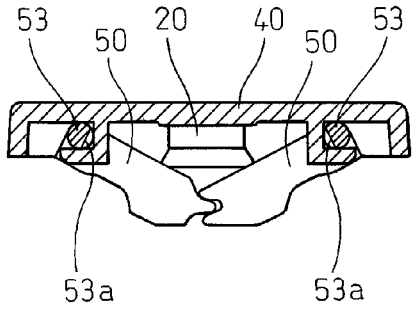
FIGS. 10A, 10B and 10C is a view illustrating a first modified example of the link members.
Figure 10B:
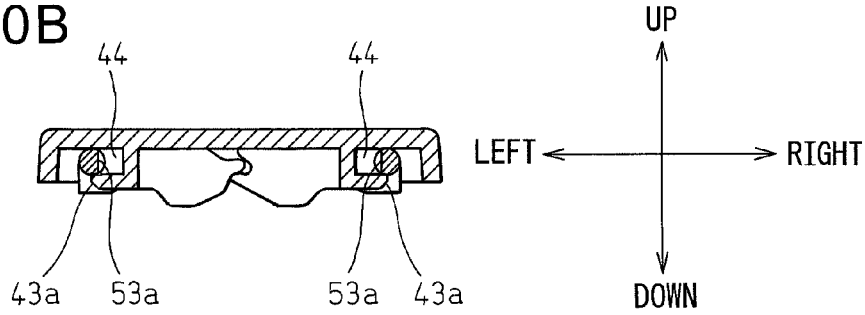
Figure 10C:
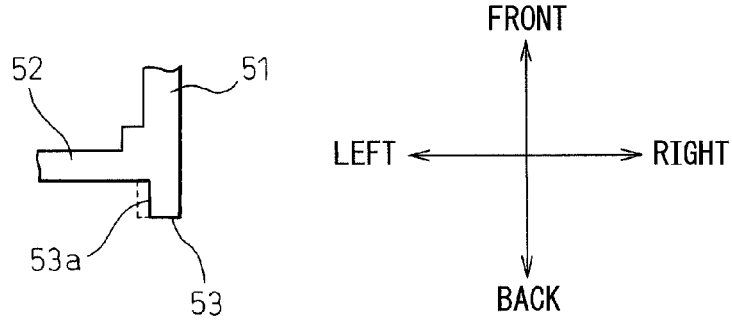

In order to facilitate the above attaching step, the guide shafts 53 of the link members 50 may be constituted as shown in FIGS. 10A, 10B and 10C, for example. FIGS. 10A and 10B is a sectional view illustrating a major portion of the switch device 100 before and after the key top 40 is pushed in operation, respectively. FIG. 10C is a view illustrating a right and back end of the guide shaft 53 in the state shown in FIG. 10B, seen from the upper side. In FIGS. 10A, 10B and 10C, the guide shafts 53 of the pair of right and left link members 50 have cut away portions so as to have a circular cross section linearly cut away. That is, flat surfaces 53*a* extending in the front-and-back direction are formed in the guide shafts 53, so that the guide shafts 53 have a substantially D-shape in cross section in side view.

In the state shown in FIG. 10A, the flat surfaces 53*a* of the right and left guide shafts 53 are oriented obliquely in a substantially symmetrical manner. In the state shown in FIG. 10B, the flat surfaces 53*a* of the right and left guide shafts 53 are oriented in the up-and-down direction, in parallel and opposite to each other. This allows the flat surfaces 53*a* of the guide shafts 53 to be guided into the guide grooves 44 along the right and left outer side end surfaces 43*a* of the shaft support portions 43 when the key top 40 is attached. Therefore, the key top 40 needs be shifted in a shorter distance in the right-and-left direction, facilitating the attaching step. Also, in attaching the key top 40, a decreased amount of force acts on the guide shafts 53, thereby preventing the shaft support portions 43 and the guide shafts 53 from being deformed or broken. When the key top 40 is pushed, the flat surfaces 53*a* of the guide shafts 53 can shift from the state shown in FIG. 10A to the state shown in FIG. 10B without making contact with the shaft support portions 43, whereby smooth sliding of the guide shafts 53 is achieved.

Figure 11A:
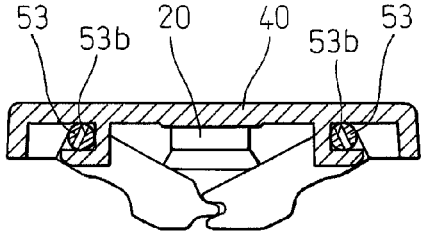
FIGS. 11A, 11B and 11C is a view illustrating a second modified example of the link members.
Figure 11B:
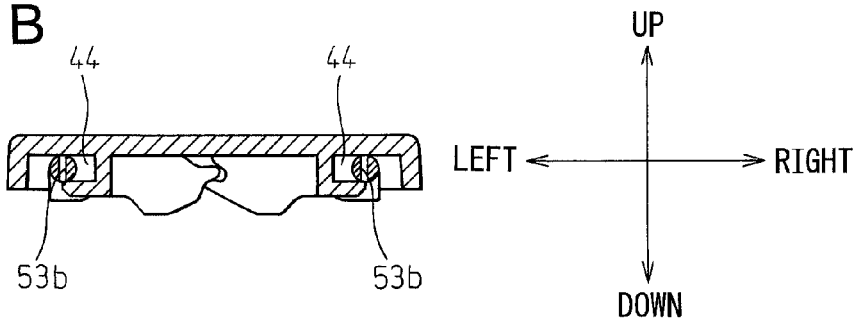
Figure 11C:
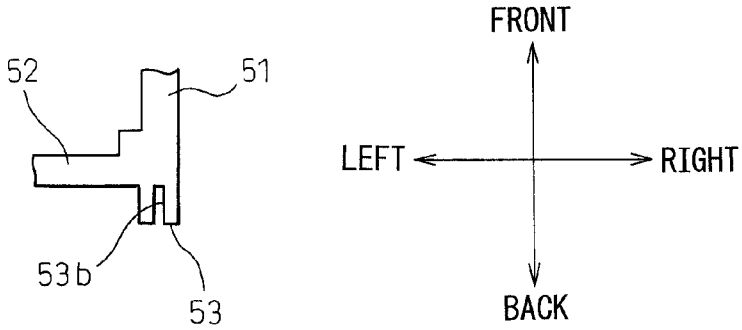

FIGS. 11A, 11B and 11C is a view illustrating a modified example of FIGS. 10A, 10B and 10C. FIGS. 11A and 11B is a sectional view illustrating a major portion of the key top 40 before and after it is pushed in operation, respectively. FIG. 11C is a view illustrating a right and back end part of the guide shaft 53 in the state shown in FIG. 11B, seen from the upper side. In FIGS. 11A, 11B and 11C, slits 53*b* are formed inwardly in the front-and-back direction on the front and back end surfaces of the guide shafts 53 of the pair of link members 50. The slits 53*b* are formed in the central portions of the front and back end surfaces of guide shafts 53 so as to extend through in the up-and-down direction in a state shown in FIG. 11B. This allows the guide shafts 53 to be easily elastically deformed in the right-and-left direction with the aide of the slits 53*b*, thereby facilitating insertion of the guide shaft 53 into the guide grooves 44.

Figure 12:
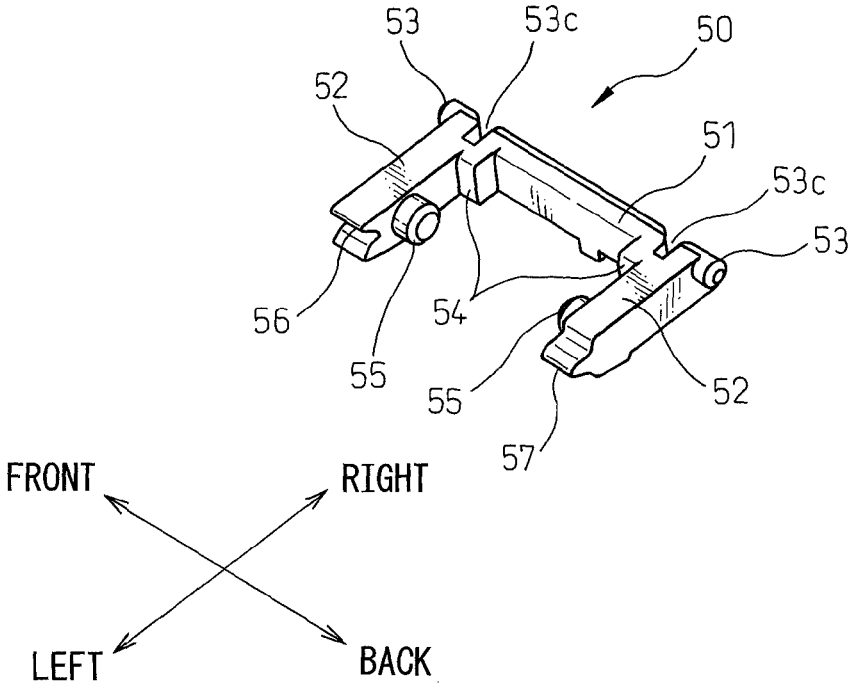
FIG. 12 is a view illustrating a third modified example of the link member.

Notches may also be formed in root portions of the guide shafts 53 to facilitate the attachment of the key top 40. FIG. 12 is a perspective view of the link member 50 showing an example thereof. In FIG. 12, notches 53*c* are formed on inner portions of the guide shaft 53 in the front-and-back direction, the notches 53*c* extending inwardly from the outer end surfaces in the right-and-left direction. The notches 53*c* extend through the link member 50 in the up-and-down direction. This results in applying compressive force onto the front and back end surfaces of the guide shaft 53 in the front-and-back direction, and therefore, the guide shaft 53 can be easily elastically deformed inwardly in the front-and-back direction, thereby facilitating insertion of the guide shaft 53 into the guide groove 44.

Figure 13A:
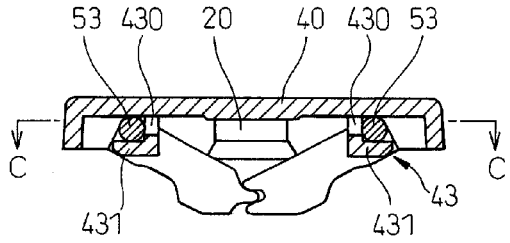
FIGS. 13A, 13B and 13C is a view illustrating a first modified example of the key top.
Figure 13B:
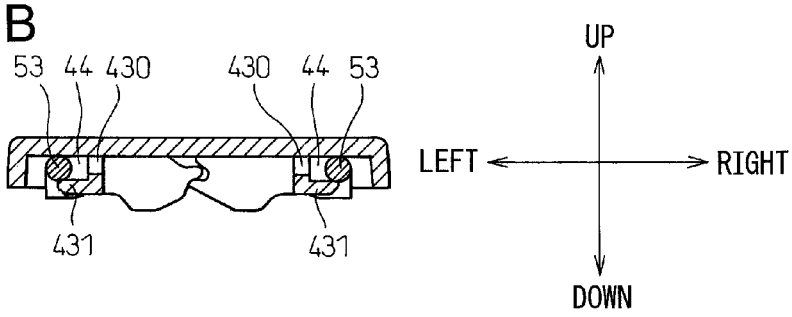
Figure 13C:
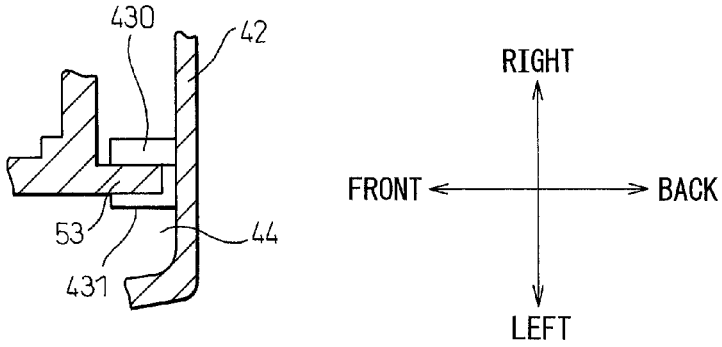

In order to facilitate attachment and detachment of the link members 50 to, and from the key top 40, the shaft support portions 43 of the key top 40 may also be constituted in an elastically deformable shape. FIGS. 13A, 13B and 13C is a diagram of an example thereof. FIGS. 13A and 13B is a sectional view of a major portion of the key top 40 before and after it is pushed in operation, respectively. FIG. 13C is a sectional view along line C-C in FIG. 13A. In FIGS. 13A, 13B and 13C, notches 430 are formed in the upper end portions of the shaft support portions 43, so as to extend in the front-and-back direction. As shown in FIGS. 13A and 13B, the shaft support portions 43 is of a substantially L-shape in cross section under the notches 430, so as to form L-shaped portions 431. The L-shaped portions 431 are elastically deformably supported at its one end by the bottom surface on the inside of the key top 40 in the front-and-back direction.

With the shaft support portions 43 provided with notches 430 as described above, the L-shaped portions 431 can be elastically deformed, and the key top 40 can be easily attached to, and detached from the link members 50 without causing the guide shafts 53 or the shaft support portions 43 to be plastically deformed or broken. In particular, when the key top 40 in the state shown in FIG. 13A is pulled up, spaces in the notches 430 (height in the up-and-down direction) are expanded by the pulling force, and the guide shafts 53 can be slid in and through the notches 430 inwardly in the right-and-left direction. This allows the key top 40 to be removed without damaging the guide shaft 53 or the shaft support portions 43 even if a user attempt to forcibly pull out the key top 40.

Figure 14A:
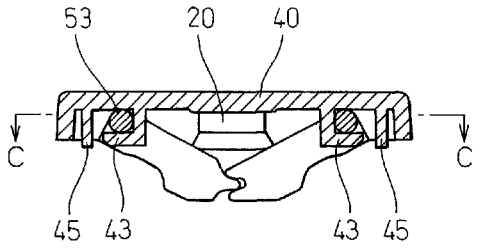
FIGS. 14A, 14B and 14C is a view illustrating a second modified example of the key top.
Figure 14B:
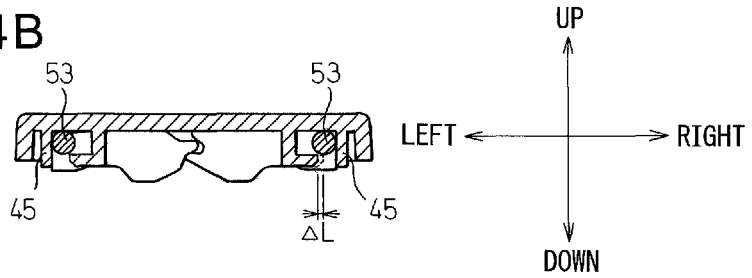
Figure 14C:
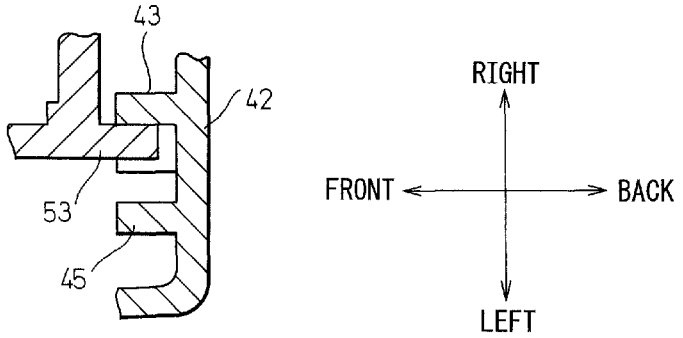

In order to facilitate the attachment and detachment of the key top 40 to and from the link members 50, undercut portions of the shaft support portions 43 for slidably guiding the guide shafts 53 may be shortened in length (length of lower portions of the shaft support portions 43 in the right-and-left direction). FIGS. 14A, 14B and 14C is a view illustrating an example thereof. FIGS. 14A and 14B is a sectional view of a major portion of the key top 40 before and after it is pushed in operation, respectively. FIG. 14C is a sectional view along line C-C in FIG. 14A. In FIGS. 14A, 14B and 14C, ribs 45 are provided to protrude on the right and left outer sides of the shaft support portions 43.

In this manner, the guide shafts 53 are guided by the shaft support portions 43 and ribs 45 and inserted into the guide grooves 44, the ribs 45 serving to prevent the shaft portions 53 from being slipped off. This allows, as shown in FIG. 14B, a length of undercut to be shortened by a predetermined length ΔL as compared to a length shown in FIG. 10C (by dotted line). As a result, the key top 40 can be easily attached to and detached from the link members 50 without causing the guide shafts 53 or the shaft support portions 43 to be plastically deformed or broken. The constitution shown in FIG. 13 may be combined with the constitution shown in FIG. 14.

In the above constitutions shown in FIGS. 13 and 14, the link members 50 do not have to be constituted as shown in FIGS. 10 to 12. Therefore, there is no need to newly fabricate a metal mold for molding the link members 50, preventing a production cost of the link members 50 being increased. Yet constitutions of the link members 50 shown in FIGS. 10 to 12 may also be applied to the embodiments shown in FIGS. 13 and 14.

Figure 15:
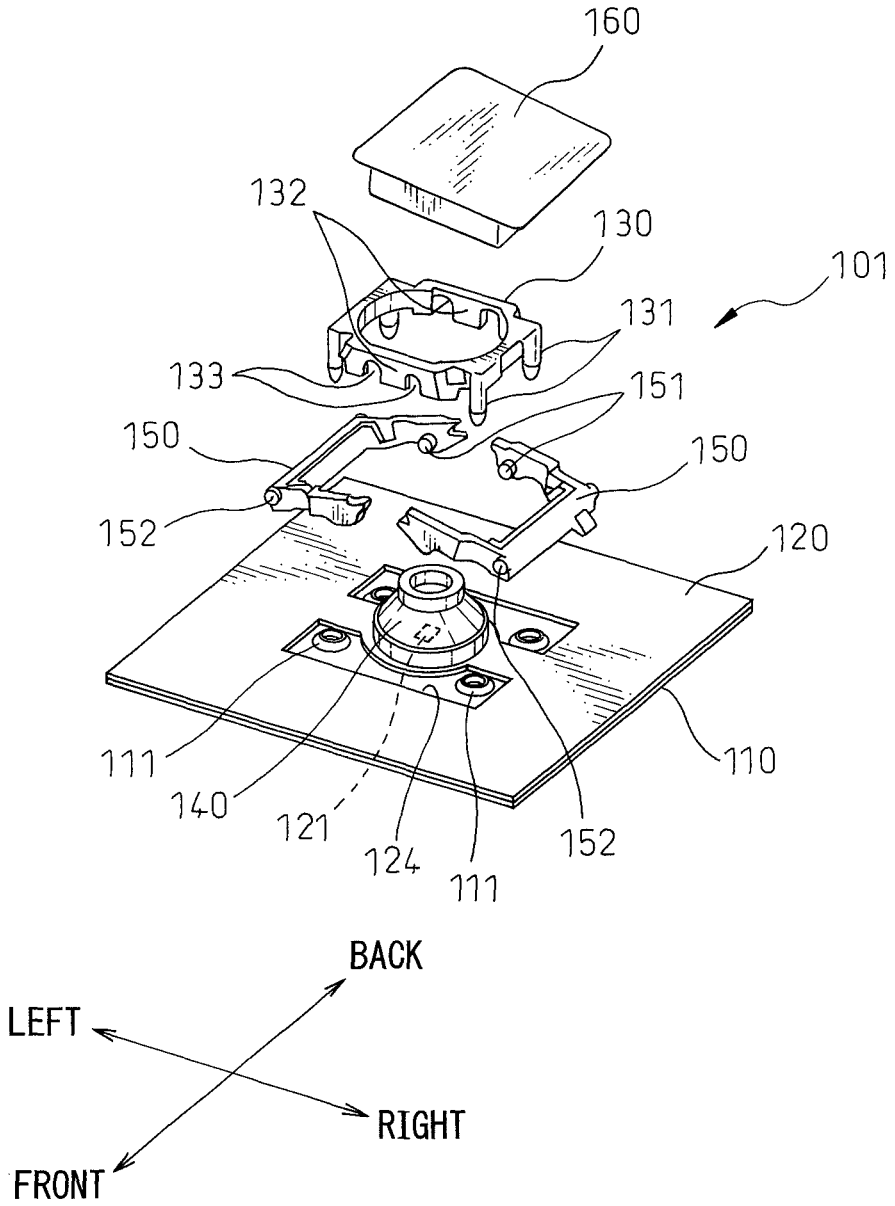
FIG. 15 is an exploded perspective view of the push button-type switch device having a membrane switch according to one embodiment of the invention.
Figure 16:
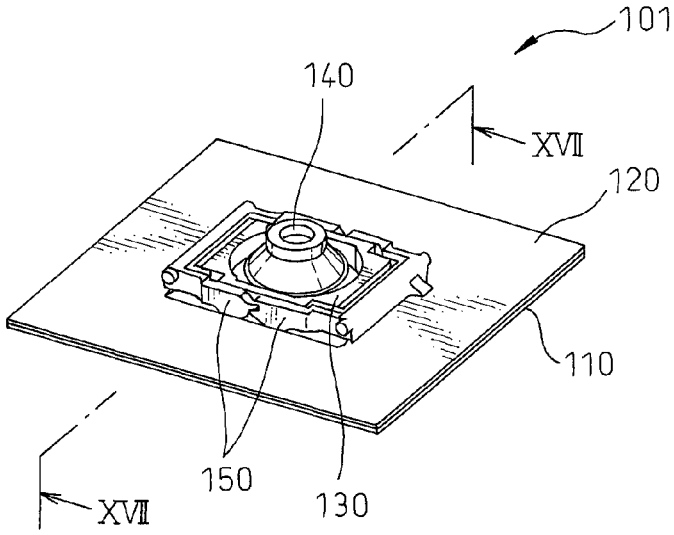
FIG. 16 is a perspective view illustrating the push button-type switch device of FIG. 15 in an assembled state.
Figure 16:
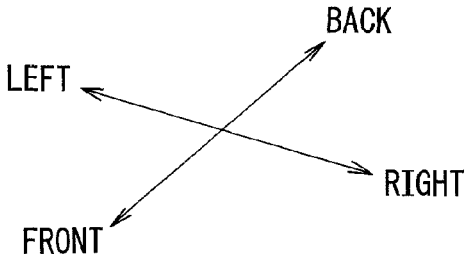

The pair of link members forming the V-shaped gear link can also be applied to a push button-type switch device having a membrane switch. FIG. 15 is an exploded perspective view of a push button-type switch device 101 to which the pair of link members are applied, and FIG. 16 is a perspective view illustrating a state where the push button-type switch device has been assembled. The key top is not shown in FIG. 16.

The push button-type switch device 101 includes a membrane switch 120 mounted on a support panel 110, a housing 130 erecting on the support panel 110, an actuating member 140 arranged on the membrane switch 120 inside the housing 130, a pair of link members 150 rotatably supported by the housing 130, and a key top 160 which is to be pushed in operation.

Basic constitutions of the link members 150 and the key top 160 are the same as those of the link members 50 and the key top 40 described above. Namely, the link members 150 is of a substantially U-shape, have shaft portions 151 formed coaxially on inner side surfaces of its arm portions so as to protrude inward in the front-and-back direction and have guide shafts 152 formed coaxially on outer side surfaces of the arm portions so as to protrude outward in the front-and-back direction. In a state where the switch device has been assembled, right and left ends of the arm portions mesh with each other, and the guide shafts 152 are inserted into guide grooves (not shown) on an inner side of the key top 160 in a slidable manner in the right-and-left direction, thereby forming a gear link of a V-shape in side view.

Figure 17:
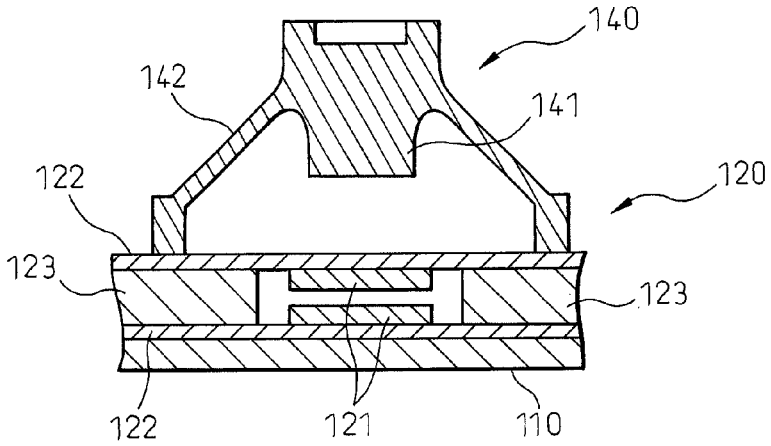
FIG. 17 is a sectional view along line XVII-XVII of FIG. 16.

The support panel 110 is a plate member made of a resin, metal or the like and has a plurality (four in the drawing) of through holes 111 therein for mounting the housing 130. FIG. 17 is a sectional view along line XVII-XVII in FIG. 16. The membrane switch 120 includes a pair of contacts 121 provided opposite to each other on an upper and lower sides, a pair of sheet substrates 122 carrying the pair of contacts 121, respectively, and a spacer 123 arranged between the pair of sheet substrates 122 so as to keep the two contacts 121 open with the sheet substrates spaced apart from each other by a predetermined distance. As shown in FIG. 15, the sheet substrate 122 has through holes in the circumference of the through holes 111, the right and left through holes in communication with each other in the sheet substrate 122, so as form a pair of front and back elongated holes 124.

An actuating member 140, similarly to the actuating member 20 described above, is substantially in the form of a dome and is arranged on the membrane switch 120 between the pair of front and back elongated holes 124. As shown in FIG. 17, a protrusion 141 is raised facing downward inside the actuating member 140 and is positioned over the contacts 121. When the key top 160 is pushed, a tapered portion 142 of the actuating member 140 is subject to elastic deformation and the protrusion 141 lowers. Lowering movement of the protrusion 141 results in predetermined downward pushing force acting on the contact 121, thereby closing the upper and lower contacts 121. When the pushing force acting on the key top 160 is released, the protrusion 141 moves up due to elastic force of the actuating member 140 and the contacts 121 are opened.

The housing 130 in the form of a substantially rectangular frame is made by resin molding and has legs 131 projecting downward at the four corners thereof. Between the right and left legs 131 of the housing 130, a pair of front and back side walls 132 extend in the right-and-left direction, respectively. The legs 131 protrude downward beyond the side walls 132. Lower end surfaces of the side walls 132 come into contact with the upper surface of the support panel 110 through the elongated holes 124, and the housing 130 is supported on the support panel 110. The legs 131 extend through the through holes 111 and their distal ends are fixed onto the support panel 110 by thermal caulking on the opposite side of the support panel 110.

On each side wall 132 of the housing 130, a pair of arcuate shaft-receiving grooves 133 are formed upward from its lower end surface, the shaft-receiving grooves 133 being spaced apart in the right-and-left direction. The housing 130 is inserted into a space between the actuating member 140 and the link members 150 from the upper side, and is fixed to the support panel 110. The shaft portions 151 of the link members 150 fit in the shaft-receiving grooves 133, and the link members 150 are rotatably supported by the housing 130.

In the above push button-type switch device 101 with the membrane switch 120, the legs 131 of the housing 130 are fixed to the support panel 110 by thermal caulking. During the thermal caulking, this results in having a high temperature on the overall support panel. As a result, contact regions (lower ends of side walls 132) where the housing 130 comes into contact with the support panel 110 are exposed to the high temperature, possibly resulting in thermal deformation of the side walls 132 of the housing 130, adversely affecting in assembling the link members 150 or in a smooth operation thereof.

In order to prevent the thermal deformation, it can be conceived of adjusting temperature or a time period for thermal caulking. However, the temperature and the time period for thermal caulking may vary depending upon the size and thickness of the support panel 110 and upon the type of the caulking apparatus. Therefore, an adjustment process requires intensive workload. In order to cope with this problem, the housing 130 may be constituted, for example, as shown in FIGS. 18A and 18B.

Figure 18A:
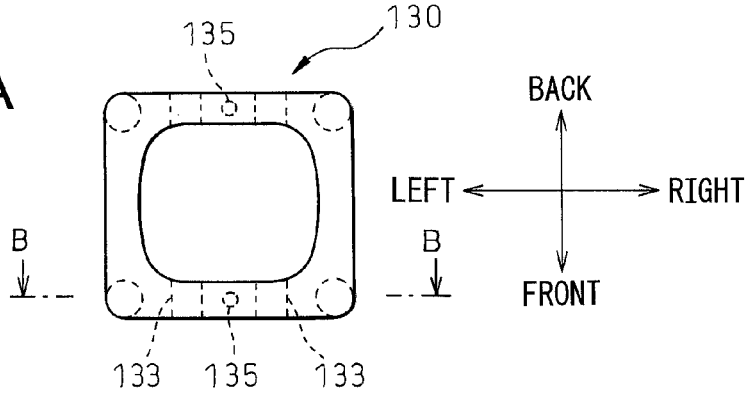
FIGS. 18A and 18B is a view illustrating a modified example of a housing of FIG. 15.
Figure 18B:
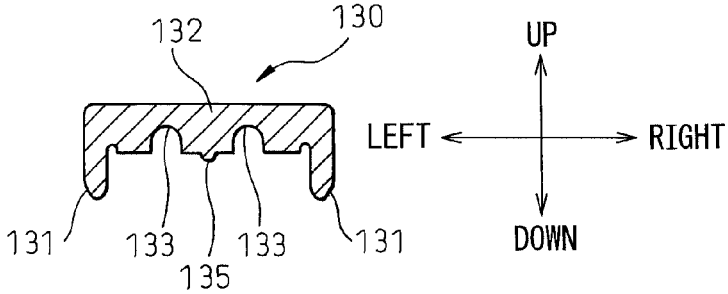

FIG. 18A is a plan view of the housing 130, and FIG. 18B is a sectional view along line B-B in FIG. 18A. In FIGS. 18A and 18B, the housing 130 has protrusions 135 formed at central portions on the bottom surfaces of the front and back side walls 132 of the housing 130. In this manner, when the housing 130 is attached, the protrusions 135 come into contact with the upper surface of the support panel 110, and a gap is formed in the areas other than the contacting portions between the lower end surfaces of the side walls 132 and the upper surface of the support panel 110. This decreases the contact surface area between the housing 130 and the support panel 110, and an amount of heat transfer from the support panel 110 to the housing 130 will decrease during the thermal caulking of the legs 131.

Figure 19A:
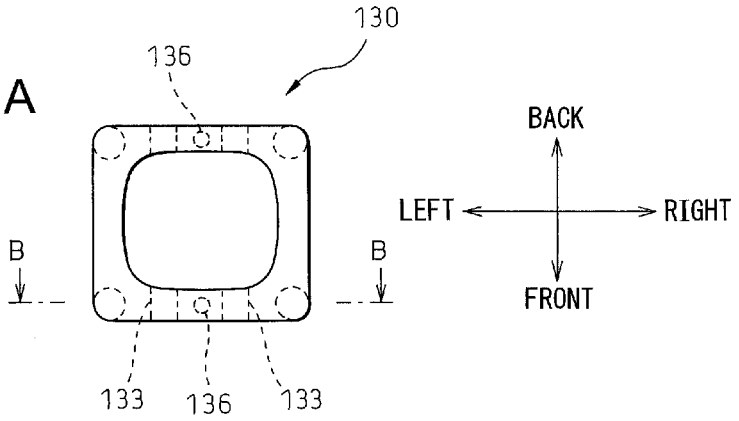
FIGS. 19A and 19B is a view illustrating another modified example of the housing of FIG. 15.
Figure 19B:
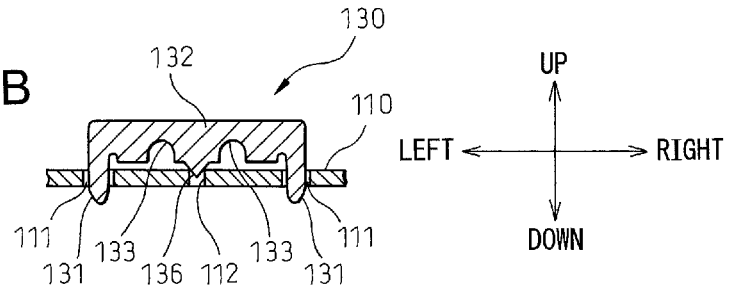

FIG. 19A is a plan view of the housing 130 showing a modified example of the housing 130 shown in FIGS. 18A and 18B. FIG. 19B is a sectional view along line B-B in FIG. 19A. FIG. 19B also shows the support panel 110. In FIGS. 19A and 19B, protrusions 136 of a substantially conical shape are formed at central portions on the bottom surfaces of the front and back side walls 132 of the housing 130, and through holes 112 are formed in the support panel 110, corresponding to the protrusions 136. The through holes 112 have a diameter smaller than that of the proximal ends of the protruded portions 136.

In this manner, when the housing 130 is mounted, peripheral surfaces of the protrusions 136 come into contact with an upper open edges of the through holes 112, and a gap is formed in the areas other than the contacting portions between the lower end surfaces of the side walls 132 and the upper surface of the support panel 110. This decreases the contact surface area decreases between the housing 130 and the support panel 110, and an amount of heat transfer from the support panel 110 to the housing 130 will decrease. In addition, by fitting the protrusions 136 into the through holes 112, the housing 130 can be positioned relative to the support panel 110, thereby preventing the housing 130 from being deviated in position during the thermal caulking.

Figure 20:
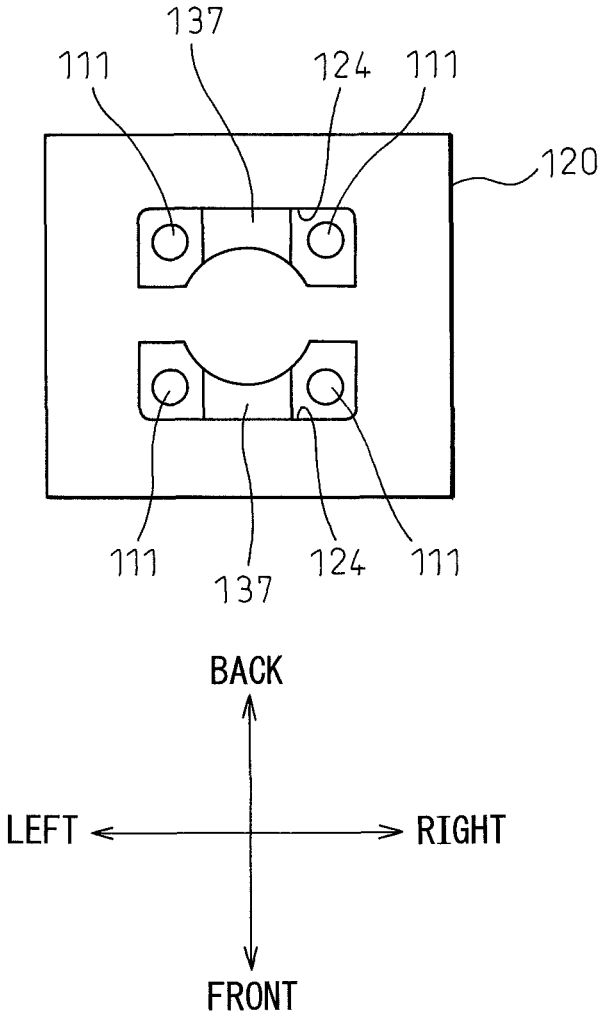
FIG. 20 is a view illustrating a modified example of the membrane switch of FIG. 15.

In FIGS. 18 and 19, protrusions 135, 136 are provided on the bottom surface of the housing 130 to reduce the amount of heat transfer from the support panel 110 to the housing 130. However, it is also possible to provide a heat-insulating film interposed between the housing 130 and the support panel 110 so as to lower the amount of heat transfer from the support panel 110 to the housing 130. FIG. 20 is a plan view of a membrane switch 120 showing an example thereof. In FIG. 20, heat-insulating films 137 are mounted on the upper surface of the support panel 110 where the side walls 132 of the housing 130 are to be placed in such a manner that the heat-insulating films 137 partly close the through holes 124 of the membrane switch 120.

This decreases an amount of heat transfer from the support panel 110 to the housing 130 during thermal caulking of the leg portions 131, thereby preventing thermal deformation of the housing 130. In this case, the same membrane films forming the surface of the membrane switch 120 can be used as the heat-insulating films 137. The membrane films are made of a PET sheet with excellent heat resistance (e.g., with upper temperature limit of 150° C.), and therefore posing no risk to melting the membrane films or the like even if they are exposed to heat for thermal caulking.

In the above embodiment (FIGS. 1 to 8), the base portion 10 provided with the pair of fixed contacts 16 is mounted on the printed board 200, but may also be mounted on other member. The gear link of a V-shape in side view is constituted by meshing the concave portions 56 and the convex portions 57 of the pair of link members 50 with each other. However, a shape of the link members 50 and an engaging manner of the pair of link members 50 are not limited thereto. Any constitution may be employed as a limiting part for limiting the direction in which the key top 40 moves, provided that the key top 40 as the operable member can be moved in an unchanged predetermined orientation with the aid of the pair of link members 50 engaged with each other. For example, the pair of link members 50 may be turned upside down, so that the shaft portions 55 are rotatably supported by the inner side of the key top 40 and that the guide shafts 53 is slidably supported by the base portion 10. The operable portion 41 of the key top 40 does not necessarily have a horizontal surface. For example, the operable portion 41 may be arranged obliquely, and the key top 40 may be moved perpendicularly (in the up-and-down direction) to the base portion 10 while maintaining the oblique surface. The pair of link members 50 are accommodated in the spaces (accommodation portions) between the side plates 12, 13 and the guide portions 14 of the base portion 10. However, when the link members 50 are turned upside down, the accommodating portions may be provided on the inner side of the key top 40.

In the above embodiments (FIGS. 10 to 12), the guide shafts 53 are formed of a substantially D-shape in cross section, or slits 53*b* are formed in the guide shafts 53, or notches 53*c* are formed in the guide shafts 53 substantially perpendicularly (in the right-and-left direction) to the direction in which the guide shafts 53 protrude. However, the guide shafts 53 which serve as sliding shafts for facilitating the attachment of the key top 40 are not limited to the above-mentioned constitutions. Although the flat surfaces 53*a* of the guide shafts 53 are, as shown in FIG. 10, guided in the guide grooves 44 along the end surfaces of the shaft support portions 43, the constitution for guiding is not limited thereto. In the above embodiment (FIG. 13), notches 430 are formed in the shaft support portions 43 to form L-shaped portions 431. However, hanging portions of any shape other than the L-shape may be possible, provided that they hang down and are spaced apart from the bottom surface of the key top 40. In the above embodiment (FIG. 14), ribs 45 are provided on the right and left outer sides of the shaft support portions 43. However, the ribs 45 may be constituted in any form, provided that they hang down from the bottom surface of the key top 40 and face the shaft support portions 43, thereby, together with the shaft support portions 43, guiding the guide shafts 53.

In the above embodiments (FIGS. 15 to 20), the membrane switch 120 including the pair of contacts 121 facing each other on the upper and lower sides is arranged on the support panel 110 that serves as a support plate. It may, however, also be possible to employ any other contact portion actuated by pushing the key top 160. The housing 130 is not limited to the above constitution, provided that it fixedly erects on the support panel 110 so as to surround the contact portion. The heat transfer reducing means is not limited to the above constitution, provided that it is constituted so as to reduce an amount of heat transfer to the housing 130 at the contact regions between the end surfaces of the housing 130 and the upper surface of the support panel 110. Although through holes 112 are formed in the support panel 110 as shown in FIG. 19, for example, the fitting portions may be constituted simply as concave portions. In FIG. 20, the heat-insulating films 137 may also be applied to the end surfaces of the housing 130. Namely, the present invention is not limited to any push button-type switch device according to the above embodiments, provided that the features and functions of the present invention may be achieved.

Although the invention has been shown and described with exemplary embodiments thereof, it should be understood by those skilled in the art that the foregoing and various other changes, omissions and additions may be made therein and thereto without departing from the spirit and scope of the invention.

The invention claimed is:

1. A push button-type switch device comprising:

a base portion provided with a pair of fixed contacts;

an operable member which moves toward said base portion upon being pushed;

an actuating member interposed between said base portion and said operable member and elastically deformable upon said operable member being pushed, said actuating member providing a counteracting force to said operable member depending upon elastic deformation of said actuating member;

a movable contact which comes into contact with said pair of fixed contacts upon said operable member being pushed, said movable contact short-circuiting said pair of fixed contacts; and a pair of link members that engage with each other and are adapted to limit a direction in which said operable member moves and make said operable member move in a fixed orientation, one ends of said pair of link members being supported by said base portion, respectively, and other ends of said pair of link members being supported by said operable member, respectively.

2. The push button-type switch device according to claim 1, wherein said base portion is mounted on a printed board.

3. The push button-type switch device according to claim 1, wherein one of said base portion and said operable member is provided with an accommodation portion for accommodating said pair of link members.

4. The push button-type switch device according to claim 1, wherein said actuating member has an elastically deformable portion which is subject to elastic deformation upon said operable member being pushed, and each of said pair of link members is of a substantially U-shape, said link members being engaged with each other and surrounding said actuating member.

5. The push button-type switch device according to claim 1, wherein said movable contact is provided on an electrically conductive leaf spring which is deformable upon the operable member being pushed.

6. The push button-type switch device according to claim 1, wherein sliding shaft portions are provided, said sliding shaft portions protruding from side surfaces of said pair of link members at the other ends of said link members; and said operable member has shaft support portions for supporting said sliding shaft portions, said shaft support portions sliding along an inner surface on an opposite side of an operable portion of said operable member.

7. The push button-type switch device according to claim 6, wherein said sliding shaft portions have a substantially D-shaped cross section with flat surfaces formed on a portion of a circular cross section; and said shaft support portions have guide portions at their ends for guiding said flat surfaces of said sliding shaft portions when said operable member is attached.

8. The push button-type switch device according to claim 6, wherein slits are formed on end surfaces of said sliding shaft portions.

9. The push button-type switch device according to claim 6, wherein notches are formed at the proximal ends of said sliding shaft portions substantially perpendicularly to a direction in which said sliding shaft portions protrude.

10. The push button-type switch device according to claim 6, wherein said shaft support portions have hanging portions which hang down and are spaced apart from the bottom surface of said operable member, and said hanging portions slidably support said sliding shaft portions.

11. The push button-type switch device according to claim 6, wherein said operable member has ribs hanging down from the bottom surface of said operable member and facing said shaft support portions, said ribs guiding said sliding shaft portions together with said shaft support portions.

12. A push button-type switch device comprising:

a support plate;

an operable member to be pushed in operation;

a contact portion arranged on said support plate and actuated upon said operable member being pushed;

an actuating member interposed between said support plate and said operable member, and elastically deformable upon said operable member being pushed, said actuating member providing a nonlinear counteracting force to said operable member depending upon elastic deformation of said actuating member;

a housing fixedly erecting on said support plate and surrounding said contact portion;

a pair of link members rotatably supported by said housing, and actuated together with said operable member upon said operable member being pushed, said pair of link members limiting a direction in which said operable member moves and making said operable member move in a direction perpendicular to said support plate; and protrusions protruding from end surfaces of said housing toward an upper surface of said support plate so as to form a gap between the end surfaces of said housing and the upper surface of said support plate.

13. The push button-type switch device according to claim 12, wherein said protrusions are of a substantially conical shape, and said support plate is provided with fitted portions to which distal ends of said protrusions fit.

14. A push button-type switch device comprising:

a support plate;

an operable member pushable in operation;

a contact portion arranged on said support plate and actuated upon said operable member being pushed;

an actuating member interposed between said support plate and said operable member, and elastically deformable upon said operable member being pushed, said actuating member providing a nonlinear counteracting force to said operable member depending upon elastic deformation of said actuating member;

a housing fixedly erecting on said support plate and surrounding said contact portion;

a pair of link members rotatably supported by said housing, and actuated together with said operable member upon said operable member being pushed, said pair of link members limiting a direction in which said operable member moves and making said operable member move in a direction perpendicular to said support plate; and heat-insulating films interposed between said housing and said support plate.

15. The push-button type switch device according to claim 1, wherein said movable contact is attached to said actuating member.

16. The push-button type switch device according to claim 15, wherein said actuating member has an elastically deformable portion which elastically deforms upon said operable member being pushed, and a protrusion provided inside of the elastically deformable portion, and said movable contact is integrally formed with said protrusion.

17. The push-button type switch device according to claim 5, wherein said actuating member has an elastically deformable portion which elastically deforms upon said operable member being pushed, and said movable contact is provided in a space inside said elastically deformable portion.

* * * * *

UNITED STATES PATENT AND TRADEMARK OFFICE

CERTIFICATE OF CORRECTION

PATENT NO. : 8,759,705 B2
APPLICATION NO. : 13/362711
DATED : June 24, 2014
INVENTOR(S) : Katsuya Funakoshi et al.

It is certified that error appears in the above-identified patent and that said Letters Patent is hereby corrected as shown below:

In the Claims

Column 14, Line 53 (Approx.), In Claim 15, Delete "push-button type" and insert -- push button-type --, therefor.

Column 14, Line 57 (Approx.), In Claim 16, Delete "push-button type" and insert -- push button-type --, therefor.

Column 14, Line 64, In Claim 17, Delete "push-button type" and insert -- push button-type --, therefor.

Signed and Sealed this
Twenty-eighth Day of October, 2014

Michelle K. Lee

Michelle K. Lee
*Deputy Director of the United States Patent and Trademark Office*